US008826900B2

(12) United States Patent
Benharbon et al.

(10) Patent No.: US 8,826,900 B2
(45) Date of Patent: Sep. 9, 2014

(54) SHUTTER HAVING A SWELLABLE PERIPHERAL SEAL AND SHUTTING SYSTEM COMPRISING IT, FOR A MULTIPLE-CHAMBER FURNACE PORT

(75) Inventors: Gérard Benharbon, Villeurbanne (FR); Pierre Mahieu, Lyons (FR)

(73) Assignee: Solios Carbone, Givors (FR)

( * ) Notice: Subject to any disclaimer, the term of this patent is extended or adjusted under 35 U.S.C. 154(b) by 1063 days.

(21) Appl. No.: 12/866,275

(22) PCT Filed: Feb. 5, 2009

(86) PCT No.: PCT/FR2009/050177

§ 371 (c)(1), (2), (4) Date: Aug. 5, 2010

(87) PCT Pub. No.: WO2009/101330

PCT Pub. Date: Aug. 20, 2009

(65) Prior Publication Data

US 2010/0313881 A1 Dec. 16, 2010

(30) Foreign Application Priority Data

Feb. 13, 2008 (FR) ..... 08 50921

(51) Int. Cl.

| | |
|---|---|
| ***F24C 3/00*** | (2006.01) |
| ***F27B 13/08*** | (2006.01) |
| ***F27B 13/02*** | (2006.01) |
| ***F27D 1/18*** | (2006.01) |
| ***F27B 13/06*** | (2006.01) |
| ***F27D 99/00*** | (2010.01) |

(52) U.S. Cl.

CPC ..... *F27B 13/02* (2013.01); *F27B 13/08* (2013.01); *F27D 1/18* (2013.01); *F27B 13/06* (2013.01); *F27D 99/0073* (2013.01)

USPC ..... 126/85 R; 432/129; 432/242

(58) Field of Classification Search

USPC ..... 431/192; 126/85 R; 432/192, 242

See application file for complete search history.

(56) References Cited

U.S. PATENT DOCUMENTS 3,052,265 A * 9/1962 Nevill ..... 138/97
3,593,971 A 7/1971 Blackman (Continued)

FOREIGN PATENT DOCUMENTS

CA 2550880 1/2007
DE 43 15 715 9/1994

(Continued)

OTHER PUBLICATIONS

International Search Report dated Jul. 6, 2009 for Application No. PCT/FR2009/050177.

*Primary Examiner* — Steven B McAllister
*Assistant Examiner* — George R Blum
(74) *Attorney, Agent, or Firm* — Frost Brown Todd LLC

(57) ABSTRACT

The invention relates to the field of what are called multiple-chamber ring furnaces, for the baking of carbon blocks, and more particularly to a shutter (13) with inflatable seal (15), for sealing off a port (8) of a hollow partition (7) in a multiple-chamber ring furnace, characterized in that its shutter comprises: a rigid core (14) of a substantially rectangular elongated shape, intended to be placed opposite a port (8) of a hollow partition (7) in said furnace, so as to shut off most of the flow area for gas entering via said port (8); and at least one inflatable air chamber (15), retracted in the deflated state in a housing of the core (14) and forming, in the inflated state, a peripheral seal (16) projecting around the perimeter of the core (15) such that said seal (16) extends around its entire periphery in order to complete the sealing off of said port (8).

13 Claims, 5 Drawing Sheets

(56) References Cited

U.S. PATENT DOCUMENTS

Figure 3B:
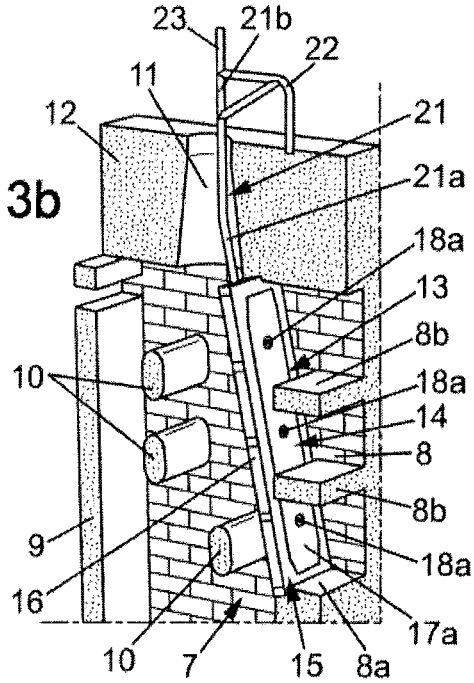

| | | | | | |
|---|---|---|---|---|---|
| 3,706,462 | A | * | 12/1972 | Lilly | 280/733 |
| 3,804,364 | A | * | 4/1974 | De Lepeleire | 251/43 |
| 3,841,256 | A | * | 10/1974 | Etchelecou et al. | 114/227 |
| 4,160,464 | A | * | 7/1979 | Ballinger | 138/93 |
| 4,373,377 | A | * | 2/1983 | Smith et al. | 73/23.31 |
| 4,442,867 | A | * | 4/1984 | de Sivry et al. | 138/93 |
| 4,522,129 | A | * | 6/1985 | Jerberyd | 104/138.1 |
| 4,859,175 | A | | 8/1989 | Dreyer et al. | |
| 5,234,374 | A | * | 8/1993 | Hyzyk et al. | 454/322 |
| 5,791,255 | A | * | 8/1998 | Box | 104/138.2 |
| 6,000,323 | A | * | 12/1999 | Schlegel | 100/35 |
| 6,004,130 | A | * | 12/1999 | Gibson | 432/192 |
| 6,059,497 | A | * | 5/2000 | Iannone | 410/87 |
| 6,194,960 | B1 | | 2/2001 | Nagumo | |
| 6,339,729 | B1 | | 1/2002 | Dreyer et al. | |
| 6,436,335 | B1 | | 8/2002 | Leisenberg | |
| 2007/0034255 | A1 | * | 2/2007 | Guest et al. | 137/78.3 |
| 2010/0183994 | A1 | * | 7/2010 | Mahieu et al. | 432/1 |

FOREIGN PATENT DOCUMENTS

| | | | | |
|---|---|---|---|---|
| EP | 0 295 192 | | 12/1988 | |
| EP | 295192 | A1 * | 12/1988 | F16L 55/12 |
| EP | 1 012 518 | | 6/2000 | |
| WO | WO 91/19147 | | 12/1991 | |

* cited by examiner

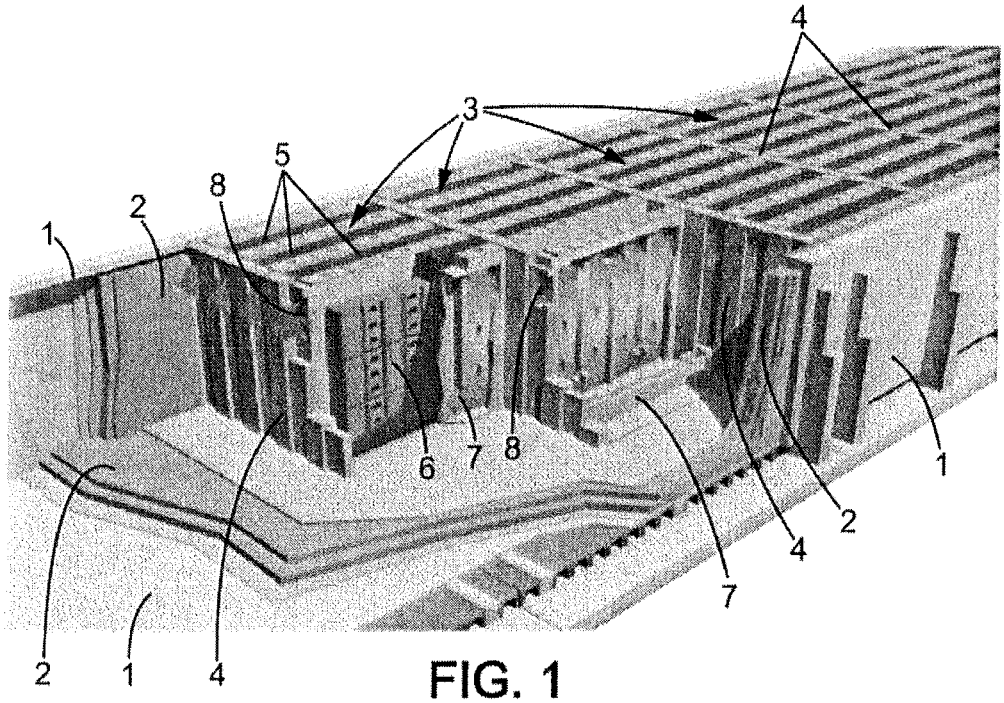
FIG. 1
FIG. 2a
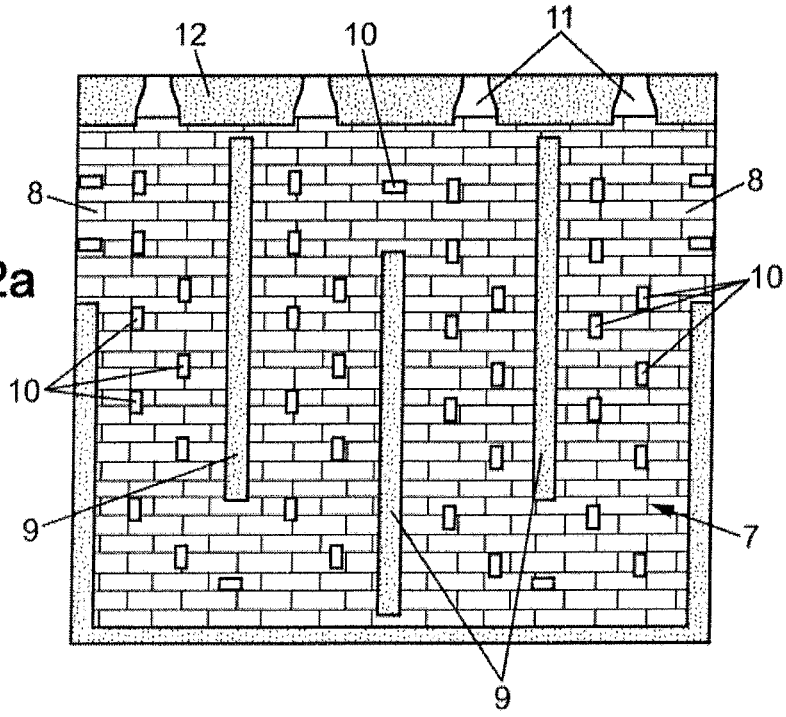

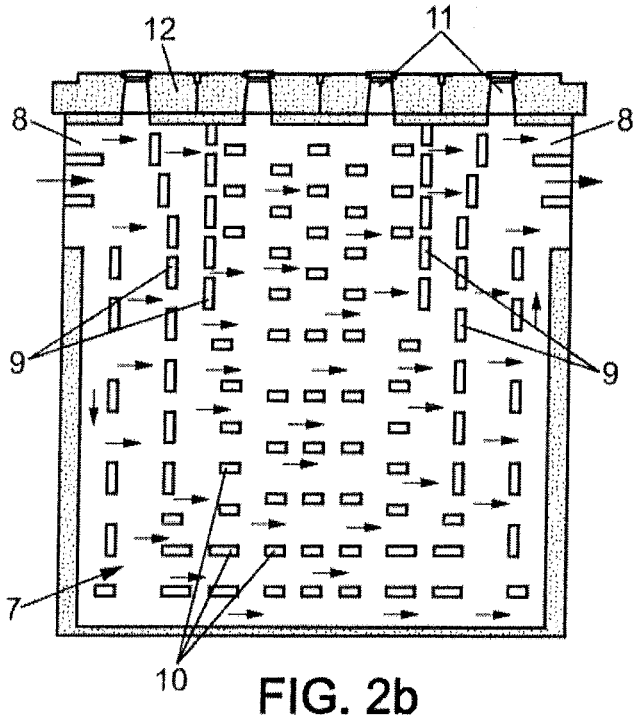
FIG. 2b
FIG. 3a
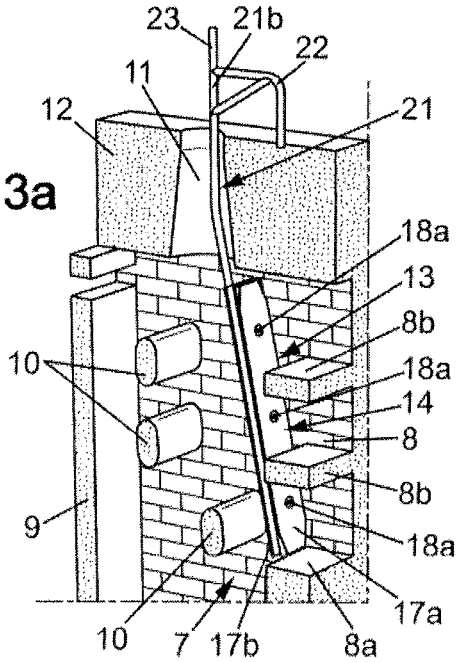

SHUTTER HAVING A SWELLABLE PERIPHERAL SEAL AND SHUTTING SYSTEM COMPRISING IT, FOR A MULTIPLE-CHAMBER FURNACE PORT

This invention relates to the field of what are called multiple-chamber "ring" furnaces, for the baking of carbon blocks and more particularly of carbon anodes and cathodes intended for the production of aluminum by electrolysis. The invention more particularly relates to a shutter for sealing a port of a hollow partition of a multiple-chamber furnace, as well as a sealing system comprising at least one shutter but preferably a plurality of shutters according to the invention, in order to optimize the seal of what is called the "combustion gas flow" area, during the operation of a ring furnace.

Ring furnaces for firing anodes are described in particular in the following patent documents: U.S. Pat. No. 4,859,175, WO 91/19147, U.S. Pat. Nos. 6,339,729, 6,436,335 and CA 2550880, which may be referred to for further information. Their structure and operation will be partially reviewed here, however, with reference to FIGS. 1, 2*a* and 2*b*. A partial perspective transverse cross-sectional view with a cutaway section representing the internal structure of such a furnace is represented in FIG. 1, and a longitudinal cross-sectional view of a conventional hollow partition of such a furnace in FIG. 2*a* and of a new generation hollow partition in FIG. 2*b*.

The furnace comprises two parallel bays extending the length of the furnace along a longitudinal axis, only one of which is represented in FIG. 1, each comprising a frame 1 with two lateral, longitudinal, vertical, and parallel walls, on a base, with the interior of said walls and base being lined with an insulation 2. Each bay also comprises a succession of transverse chambers 3 separated from each other by transverse walls 4. The length of each chamber 3, meaning in the transverse direction of the furnace, is constituted of hollow partitions 7 adjacent to and alternating with pits 5 open in their upper part to allowing loading the carbon blocks 6 to be baked and unloading the cooled baked blocks 6, and in which are stacked the carbon blocks 6 to be baked. The partitions 7 of one chamber 3 are in the longitudinal extension of the hollow partitions 7 of other chambers 3 in the same span, and these hollow partitions 7 communicate with one another by means of ports 8 in the upper part of their transverse wall facing longitudinal passages arranged in the transverse walls 4, such that the hollow partitions 7 form lines of longitudinal partitions parallel to the length of the furnace and within which gases will circulate (combustion air, combustible gases, and combustion gases and fumes) to ensure the blocks 6 are preheated and baked, then cooled.

The hollow partitions 7 additionally comprise a system of baffles 9 to prolong and more uniformly distribute the path of the combustion gases or fumes, and a series of transverse spacers 10 distributed throughout to ensure that their thin walls are mechanically supported, as is represented in the cross-sectional views in FIGS. 2*a* and 2*b*. The hollow partitions 7 also have closable openings 11 in their upper part, called peepholes, arranged in a block 12 crowning the corresponding chamber 3 of the furnace. In FIG. 2*b*, the baffles 9 of the new generation enclosure 7 differ from those of the partition 7 in FIG. 2*a* in that they allow distributing combustion gases throughout the entire partition without forming an obstacle to the passage of the gases.

To isolate the partitions 7 of the furnace upstream from the firing areas to allow the complete transfer of fumes to an exhaust manifold and avoid any infiltration of cold air which would cause a decrease in heat efficiency, and any deterioration of equipment due to corrosion resulting from the formation of acid compounds, shutters are introduced through peepholes 11 in order to seal off the ports 8 of the partitions 7 of a furnace chamber 3, which requires removing the removable covers from these peepholes 11.

The shutters commonly used today in ring furnaces are composed of a fixed or manually deployable plate, connected to a maneuvering shaft for inserting a shutter into a hollow partition by passing it through a peephole and positioning it then maintaining it in position next to the port 8 to be sealed.

Positioning the shutter in the partition 7 consists of bracing the plate of the shutter against the port 8 through which the gases pass. This is a delicate operation, because the narrow passage of the peephole 11 offers little freedom of movement. As the hollow partitions 7 age, the operation of bracing the shutter in place becomes more difficult and the infiltration of cold air becomes quite frequent.

Another type of shutter is known from patents U.S. Pat. Nos. 6,004,130, 6,194, 960, and EP 1 012 518. It is in the form of an inflatable bladder assembled at the end of a hollow shaft, which when inflated obstructs a port 8 through which the gases flow. The primary disadvantage of this type of inflatable seal is that it requires the presence of appropriately positioned spacers to ensure that the inflated bladder is correctly braced in place. In particular, the spacers must not be arranged in a zigzag pattern as represented in FIG. 2*a*. Plus, in a furnace of this type that has been in operation for several years, the spacers are weakened by the thermal expansion cycles and the additional pressure exerted by the inflated bladder could aggravate this, considerably reducing the service life of the spacers. In addition, the inflatable bladder is not mechanically protected during the operations of inserting and removing the seal through an opening such as 11, and there is a significant risk of wear and/or tear on the membrane or fabric of the inflatable bladder.

The problem leading to the invention concerns the need for a solution to these disadvantages, while sealing off the ports with a seal that is at least as good as what is obtained with the state-of-the art inflatable bladder and is appropriate for furnaces of this type that have hollow partitions braced by spacers in a zigzag pattern. In general, the purpose of the invention is to propose a shutter that more appropriately satisfies the various requirements of the art than the known seals.

The object of the invention is therefore a shutter with inflatable seal, for a port of a hollow partition of a ring furnace, characterized in that it comprises:

- a rigid core of a substantially rectangular elongated shape, for placement next to a port of a hollow partition of said furnace in order to seal off the major portion of the flow area for the gas passing through said port, and
- at least one inflatable air chamber, which is retracted into a housing in the core in its deflated state, and which forms a peripheral seal protruding around the edge of the core in its inflated state, such that said seal extends along its entire periphery in order to complete the sealing off of said port.

When the air chamber is in the inflated state, the major portion of the flow area through the port is sealed off by the core of the shutter, while the inflated peripheral seal realized in this manner seals off the rest of the gas flow through the peripheral gap between the core and the lateral walls of the hollow partition, the base of the port, and the ceiling of the hollow partition.

The maneuvering operations, particularly the phases of inserting the shutter into and removing it from a partition through a peephole, are facilitated because they are performed when the air chamber is deflated, which protects the air chamber from wear when it rubs against the walls.

In the inflated state, the peripheral seal formed by the air chamber completes the obstruction of the port by ensuring a complete seal, independently of partition irregularities.

In a first embodiment, the housing provided in the core for receiving the air chamber can be a groove along the periphery of the core, into which the air chamber retracts, said air chamber being an inflatable tube which in the inflated state protrudes outside said groove to form the peripheral seal.

In a simpler and more economical embodiment of the structure, the core of the shutter comprises two rigid plates substantially of the same flat shape, preferably made of metal rectangular and elongated with beveled corners, rigidly fixed by spacers to be apart from and facing one another, delimiting between them a housing which receives the inflatable air chamber and which is peripherally open between the two plates to allow the formation of the peripheral seal when said air chamber is in the inflated state.

In this embodiment, the two plates of the core are advantageously fixed to each other in a manner which can be disassembled for replacement of a damaged air chamber.

The air chamber is made of a material that is substantially airtight and is resistant to heat and to the temperatures and corrosive properties of the combustion gases and fumes, and which is elastically deformable, such as an elastomer, a polyurethane sheet, or silicone rubber, and/or is flexible, such as NYLON® or PTFE fabric.

To guarantee excellent protection of the air chamber, the shutter is advantageously equipped with a device to retract the deflated air chamber into the core.

In a first embodiment, the retraction device can comprise at least one elastically deformable return member, such as at least one elastic cord internal to the air chamber, or at least one elastic strap external to the air chamber, which expands as the air chamber is inflated and which elastically retracts to its relaxed state as the air chamber is deflated, retracting said air chamber into the core.

In another embodiment, the retraction device can comprise a pantograph collapsing mechanism, arranged in the air chamber such that the inflation of said air chamber causes two shields connected to each other by at least one pantograph to move apart; the opening of the pantograph or pantographs compresses at least one return spring which, when the air chamber deflates, is released and causes the pantograph or pantographs to close and the air chamber to collapse into its housing in the core.

The shutter of the invention is preferably equipped with a maneuvering shaft secured to the core by a lower end portion of the shaft, preferably slightly angled relative to an upper end portion of the shaft which is equipped with a guide and brace piece to facilitate positioning the shutter inside the hollow partition and bracing the shutter in place on said furnace.

In this case, the maneuvering shaft is advantageously at least partially tubular and equipped at one end of the tubular portion with a quick coupling connector for connecting to an inflation/deflation system supplied with compressed air, the other end of the tubular portion of the shaft being connected to the inside of the air chamber.

The shutter is also advantageously equipped with a visual control device to monitor the inflation pressure of the air chamber and if the maneuvering shaft is at least partially tubular, this visual control device is preferably a gauge mounted on the shaft.

In all embodiments, it is advantageous if the core of the shutter of the invention is arranged to allow bracing the shutter against the base of the corresponding port, and/or between said base of the port and a spacer internal to the corresponding partition.

Another object of the invention is a sealing system, for sealing off at least one port of a hollow partition of a ring furnace, characterized in that it comprises at least one shutter of the invention and as defined above, and an air chamber inflation/deflation system, comprising a connector, preferably a quick coupling and self-sealing connector, for connecting to a compressed air supply, and connected to a pressure regulator, itself connected to an inflation/deflation selector valve connected on the one hand to the air chamber of said at least one shutter, for inflating it by means of a safety valve and an individual manual control of the inflation and deflation of said air chamber, and on the other hand to a discharge venturi, connected to said air chamber by said individual control and a pilot valve controlled by said selector valve to selectively control the isolation of the venturi when the air chamber is inflated, and supplying the venturi with compressed air to permit said air chamber to deflate by suction.

In a preferred embodiment, to seal off the ports of hollow partitions of a same chamber of said furnace, the sealing system of the invention comprises a shutter of the invention and as presented above, for each of the hollow partitions of said furnace chamber, the shutters being connected in parallel to the inflation/deflation valve and to the discharge venturi of an inflation/deflation system shared by the air chambers of the shutter.

In this case, to facilitate fire advancements, the shutters are advantageously placed together on a common sealing platform, extending above said furnace chamber and equipped with a respective supporting arm to support each shutter positioned outside the corresponding hollow partition, and with a connector to a compressed air distribution system and/or with at least one air compressor in order to supply air to the inflation/deflation system.

Figure 4:
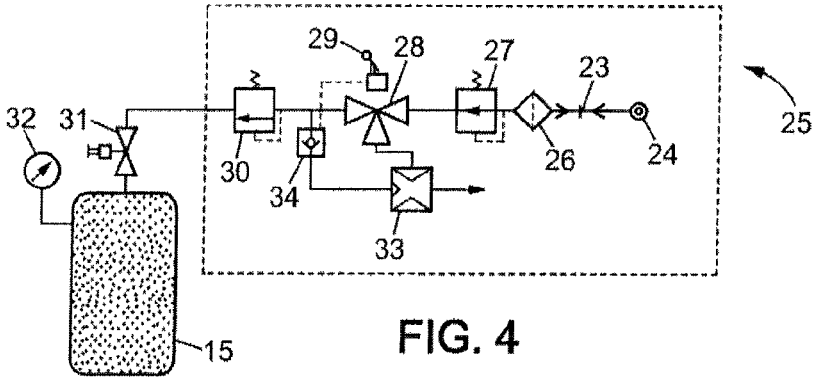
Figure 5:
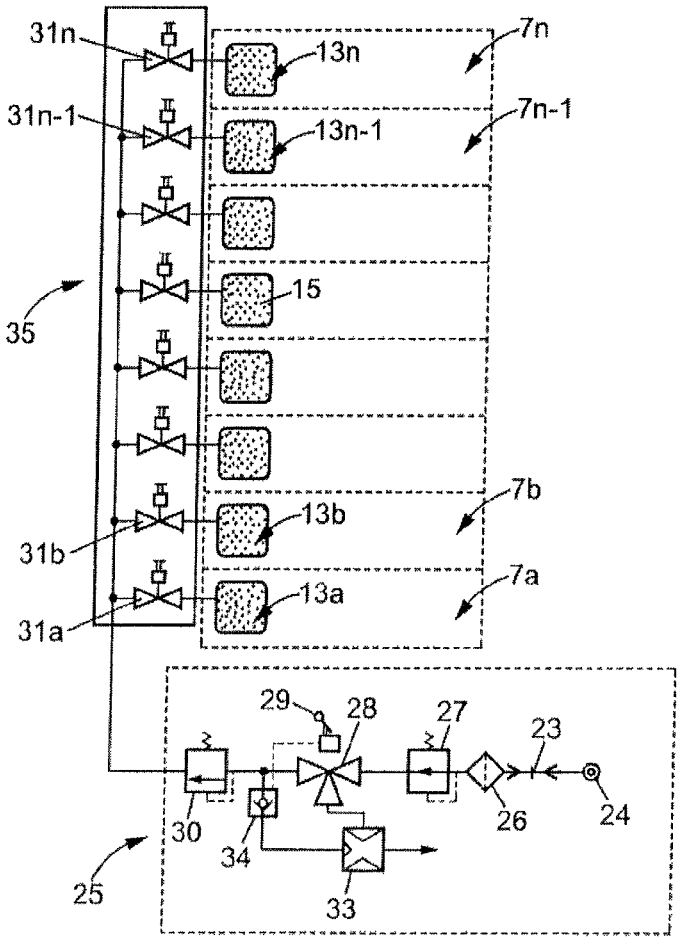
Figure 6A:
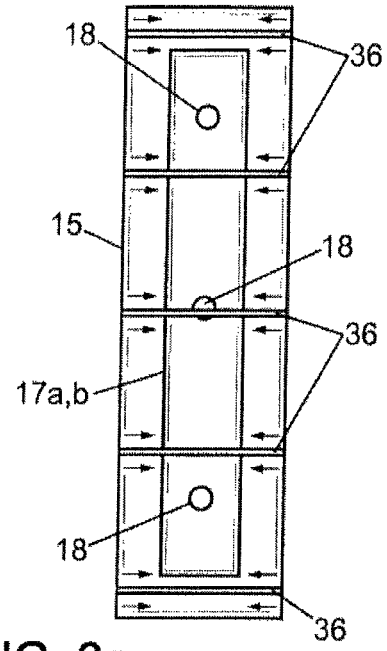
Figure 6B:
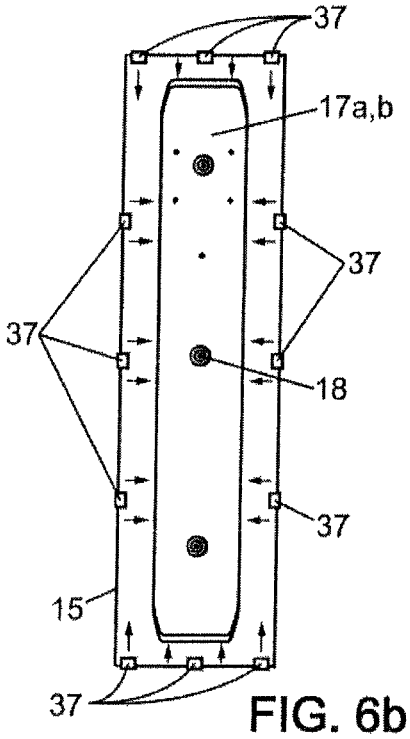
Figure 6C:
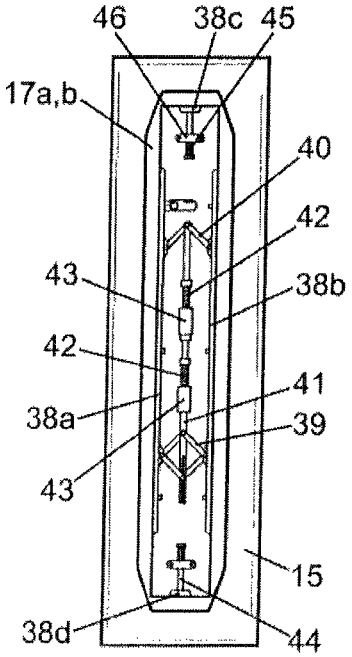
Figure 6D:
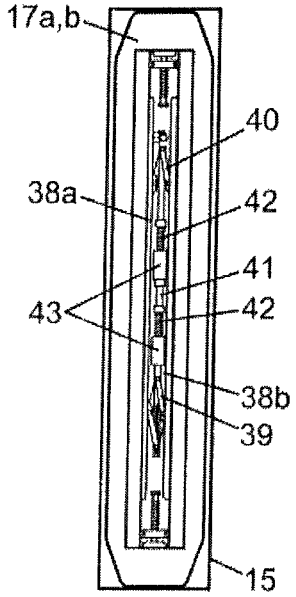

Other features and advantages of the invention will become apparent from the following non-limiting descriptions of embodiments, while referring to the attached drawings in which:

FIG. 1 is a partial and schematic representation of a transverse cross-sectional perspective view of a bay of a ring furnace, with a cutaway section, FIGS. 2*a* and 2*b* are longitudinal cross-sectional views of two embodiments of hollow partitions of a furnace according to FIG. 1; FIGS. 1, 2*a* and 2*b* were described above, FIGS. 3*a* and 3*b* are partial schematic views representing a shutter of the invention, positioned next to a port to be sealed; FIG. 3*a* shows the deflated state of the peripheral seal and FIG. 3*b* shows the inflated state of this seal, FIG. 3*c* is an exploded perspective view of an embodiment of the core and air chamber of a shutter according to the invention, FIG. 4 is a schematic representation of a pneumatic system for inflating/deflating the air chamber of a shutter of the invention, FIG. 5 is a schematic representation of a sealing system comprising as many shutters as the furnace chamber comprises partitions, in which the air chambers are inflated and deflated by means of a shared or common inflation/deflation system with compressed air, FIGS. 6*a* and 6*b* schematically represent two retraction devices with elastically deformable return members, for retracting the deflated air chamber into the core, and FIGS. 6*c* and 6*d* represent an air chamber retraction device comprising a pantograph mechanism, respectively shown in the deployed and retracted positions.

As represented in FIGS. 3*a* and 3*b*, the shutter 13 of the invention comprises a central core 14, rigid and sufficiently refractory to resist the temperature of the gases and fumes circulating in the hollow partitions 7 and passing through the ports 8, this rigid core 14, for example of a metallic material, being of a substantially rectangular elongated flat shape, so that it can be placed next to a port 8 of a hollow partition 7 of the furnace, and thus seal off the major portion of the flow area for the gas passing through this port 8. The shutter 13 also comprises an inflatable air chamber 15, visible in FIG. 3*b* which represents the shutter 13 with the air chamber 15 in its inflated state, in which this air chamber 15 forms a peripheral pneumatic seal 16 surrounding the rigid central core 14 along its entire perimeter, while in the deflated state, represented in FIG. 3*a*, the air chamber 15 is not visible because it is retracted inside a housing arranged in the central core 14.

In the inflated state of the air chamber 15, the pneumatic peripheral seal 16, which protrudes around the periphery of the central core 14, completes the seal of the flow area for the gas passing through the port 8, which is primarily ensured by the central core 14, as is visible in FIG. 3*a*. In FIG. 3*b*, the port 8 is completely sealed and airtight, because the pneumatic peripheral seal 16 seals off the gap between the periphery of the central core 14 and the surrounding walls of the hollow partition 7.

Figure 3C:
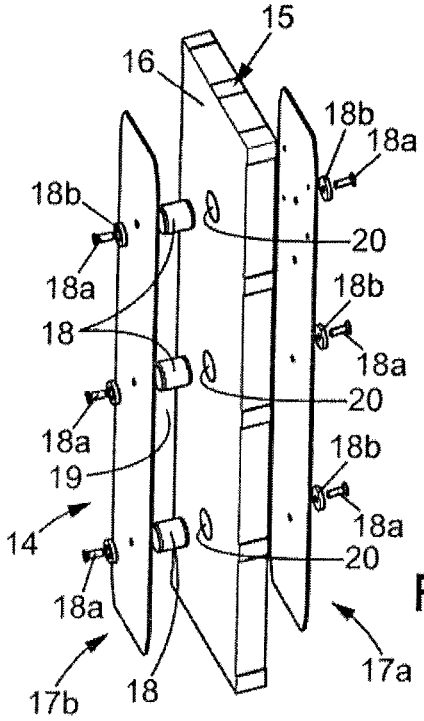

In practice, as represented in FIG. 3*c*, the rigid core 14 is constituted of two metal plates 17*a* and 17*b*, of the same elongated rectangular shape with beveled or rounded corners, fixed in place apart from and facing each other by three tubular spacers 18; the plates 17*a* and 17*b* are fixed to the ends of these spacers 18 by screws 18*a* passing through washers 18*b* placed against the outside faces of the plates 17*a* and 17*b*, and passing through openings bored in these plates in order to screw into the threaded opposing ends of the tubular spacers 18. The air chamber 15 is an inflatable cushion which fills the volume 19 delimited between the two plates 17*a* and 17*b*, and inside said volume this air chamber 15 surrounds each spacer 18 respectively passing through an airtight passage 20 of corresponding shape arranged in the air chamber 15, represented in the inflated state in FIG. 3*c*, such that its periphery constitutes the peripheral pneumatic seal 16 protruding outside the housing 19 between the plates 17*a* and 17*b* along the entire perimeter of these plates. Thus, the two plates 17*a* and 17*b* of the core 14 of the inflatable air chamber 15 shutter 13 of FIG. 3*c* are fixed to each other in a manner that can be disassembled, so that if the air chamber 15 is damaged it can easily be replaced once the screws 18*a* are unfastened. In the assembled state of the shutter, the inflatable air chamber 15, whether inflated or deflated, is retained in the housing 19 by the spacers 18.

When the shutter 13 is in its deployed or use position (see FIG. 3*b*), because the inflated air chamber 15 is exposed to relatively hot gases and fumes, at least at the peripheral pneumatic seal 16, the air chamber 15 must be made of a material which is not only substantially airtight to the inflation gas, usually compressed air, but also substantially resistant to heat and to the temperatures and corrosive properties of said combustion gases and fumes in the hollow partitions 7 of the chamber 3 where the ports 8 must be sealed. An elastically deformable membrane can be used, made for example of an elastomer or a sheet of polyurethane or silicon rubber, or from a flexible membrane, for example a textile structure such as a NYLON® or PTFE fabric, or a NOMEX® fabric, or a composite membrane made of a matrix of polyurethane or silicon reinforced with fabric such as non-woven or woven NYLON® or PTFE. It can also be a sheet of a flexible textile structure covered with a NOMEX®, NYLON®, or PTFE covering.

The shutter 13 also comprises a maneuvering shaft 21, with a lower end portion 21*a* that is secured to the rigid core 14 of the shutter 13, enabling an operator to maneuver the opposite end portion called the upper end portion 21*b* of this shaft 21 in order to pass the core 14 and the deflated air chamber 15 through a peephole 11 in the immediate proximity of a port 8 to be sealed, when introducing the shutter 13 into the corresponding hollow partition 7 or removing the shutter 13 from said partition 7, as well as to maneuver the shutter 13 into the partition 7 and position it in an appropriate manner next to the port 8, with the air chamber 15 still deflated and retracted into the housing 19 between the two plates 17*a* and 17*b* of the core 14, not only to facilitate such operations for inserting, retracting, or positioning the shutter 13, but also to protect the deflated air chamber 15 from wear and damage from rubbing or contact with the walls, spacers 10, and peepholes 11.

To facilitate these operations, the shaft 21 is slightly angled between its lower 21*a* and upper 21*b* end portions, which facilitates positioning the core 14 at an incline and next to the port 8 (see FIG. 3*a*), as the structure of the core 14 with its two separated plates 17*a* and 17*b* is favorable to supporting and properly bracing the lower end of the shutter 13, in a use position by overlapping an edge at the base 8*a* of the port 8, with the core 14 between this base 8*a* of the port 8, spacers 8*b* which subdivide this port 8 into several passages, on one side, and an internal spacer 10 of the corresponding hollow partition 7, on the other side.

In addition, the upper end portion 21*b* of the shaft, which is still protruding outside the peephole 11 when the shutter 13 is in the proper deployed position, is equipped with a guide and brace piece 22 to facilitate the positioning of the shutter 13 in the hollow partition 7 by the operator, particularly for small rotational movements around the axis of the rectilinear upper end portion 21*b* of the shaft, and which also facilitates bracing the shutter 13 in its deployed position on the furnace, as represented in FIGS. 3*a* and 3*b*, by supporting the piece 22 on the crowning block 12.

When the shutter is in its fully deployed and sealing position over the port 8 (FIG. 3*b*), with the air chamber 14 inflated and the peripheral pneumatic seal 16 established, there is a complete seal regardless of any irregularities in the walls of the partition 7, and because the shutter 13 was already braced against the base 8*a* of the port 8 by the rigid core 14, the inflation pressure of the air chamber 15 is exerted only on the lateral walls and base 8*a* of the port 8, as well as on the lower face of the crowning block 12. The spacers 10 of the hollow partition 7 and the spacers 8*b* of the ports 8 are therefore neither stressed nor weakened except by thermal stresses, and as a result their service life is increased.

Inflation and deflation of the air chamber 15 are ensured by the maneuvering shaft 21, which is tubular along its entire length, and which is connected to the interior of the air chamber 15 by an airtight connector attaching the lower end of the shaft 21 to the air chamber 15, while the upper end of this shaft 21 is equipped with a quick coupling self-sealing connector 23, for selectively connecting the air chamber 15 of the shutter 13 to a supply of compressed air for inflation, and to the atmosphere for deflation.

As is represented in FIG. 4, this quick coupling connector 23 allows connecting a compressed air supply 24 to an inflation/deflation system 25 for the air chamber 15 of the shutter 13 of FIGS. 3*a* to 3*c* in order to form a sealing system for a port 8 of a hollow partition 7, in which the inflation/deflation system 25 can be integrated into the shutter 13 by being supported directly by its maneuvering shaft 21 and/or its guide and brace piece 22.

In FIG. 4, the core 14, the shaft 21, and the guide/brace piece 22 of the shutter 13 are not represented to simplify the figure; the shutter 13 itself is only represented by its inflatable air chamber 15 connected to the abovementioned inflation/deflation system 25 now described.

The quick coupling connector 23 connects the compressed air supply 24 to a filter 26 followed by a pressure regulator 27 of the type controlled by the supply pressure, itself connected to a first of three ways of a valve 28 with two positions for selecting inflation and deflation configurations for the air chamber 15. This valve 28 comprises a manual lever 29 which is moved to differentiate between the inflation and deflation configurations. In the inflation configuration, the air valve 28 is connected by a second way to a safety valve 30, also controlled by its inlet pressure, which is in turn connected to a valve or stopcock 31 for manually controlling the inflation or deflation of the air chamber 15, whose inflation pressure is indicated by a gauge 32 equipping the shutter 13 and for example mounted on its shaft 21, as a visual control indicator or device for monitoring the inflation pressure of the air chamber 15.

In parallel, this second way of the selector valve 28 is also connected to the suction nozzle of a discharge venturi 33 by means of a pilot valve 34 controlled by the selector valve 28 so that it is closed when the valve 28 is in the inflation configuration, and open when the valve 28 is in the deflation configuration.

Finally, the third way of the selector valve 28 is connected to the venturi 33, so that when the selector valve 28 is in the deflation configuration, said valve supplies the venturi 33 with compressed air, generating a negative pressure in the suction nozzle and in the line from the pilot valve 34, from the safety valve 30, from the manual control 31, and from the air chamber 15. It is understood that once the inflation or deflation configuration is chosen in the selector valve 28, the operator manually activates the manual control 31 to inflate the air chamber 15 with compressed air, or to deflate it by means of the negative pressure generated in the venturi 33 when supplied with compressed air by the selector valve 28.

As it is necessary to seal off a port 8 in each of the hollow partitions 7 of the same furnace chamber 3, an advantageous embodiment of the sealing system is represented in FIG. 5, which combines n shutters $\mathbf{13}_a$, $\mathbf{13}_b$, . . . $\mathbf{13}_{n-1}$ and $\mathbf{13}_n$, each of which is intended to seal a port 8 of one of the respective n hollow partitions $\mathbf{7}_a$, $\mathbf{7}_b$, . . . $\mathbf{7}_{n-1}$ and $\mathbf{7}_n$ of the chamber 3 concerned. These n shutters, each identical to the one 13 described above and represented schematically in FIGS. 3*a* to 3*c*, are placed together on a common sealing platform of a mechanical structure which is schematically represented as 35 in FIG. 5 and which extends above this chamber 3 of the furnace, transversely above the hollow partitions $\mathbf{7}_a$ to $\mathbf{7}_n$. On this sealing platform 35, the inflatable air chambers 15 of the shutters $\mathbf{13}_a$ to $\mathbf{13}_n$ and the respective individual manual inflation/deflation controls $\mathbf{31}_a$ to $\mathbf{31}_n$ are connected in parallel, by means of the safety valve 30, on the one hand to the selector valve 28 with its manual lever 29 and on the other hand to the discharge venturi 33 of an inflation/deflation system 25 which is common to all the air chambers 15 of the shutters $\mathbf{13}_a$ to $\mathbf{13}_n$ and which constitutes a general pneumatic control system placed on the platform 35, said platform also being equipped with a respective supporting arm (not represented) for supporting each shutter $\mathbf{13}_a$ to $\mathbf{13}_n$ when this shutter is outside the corresponding hollow partition $\mathbf{7}_a$ to $\mathbf{7}_n$, to facilitate the movements of the sealing platform 35 carrying all the shutters $\mathbf{13}_a$ to $\mathbf{13}_n$ and their general inflation/deflation control system 25, supplied with air by a compressed air distribution network to which it is connected by a connector such as 23 or by at least one air compressor, mounted on the sealing platform 35, to provide the primary or backup supply for the compressed air system 25.

In the installation in FIG. 5, the common or individual activation of the inflation or deflation of all the shutters $\mathbf{13}_a$ to $\mathbf{13}_n$, or of only one or some of them, is enabled by activating the corresponding individual manual control(s) $\mathbf{31}_a$ to $\mathbf{31}_n$, which facilitates the fire advancement operations while retaining the ability to deflate a damaged air chamber 15 of one or more shutters 13 of a same chamber 3, in order to do an immediate replacement.

In addition, when an air chamber 15 is deflated, in order to guarantee complete retraction of this air chamber into the housing 19 in the rigid core 14 of the corresponding shutter 13, the air chamber 15 is equipped with a retraction device, of which two embodiments comprising elastically deformable return members are schematically represented in FIGS. 6*a* and 6*b*.

In FIG. 6*a*, this retraction device comprises, for example, five elastic cords 36, each of which is an elastic ring glued to the inside face of the air chamber 15, such that these rings 36 expand by elastic deformation as the air chamber 15 inflates between the two plates 17*a* and 17*b*, and upon deflation of the air chamber 15, the cords 36 elastically retract to their relaxed state, and participate in the deflation of the air chamber 15 which is thus completely retracted inside the housing 19 between the two plates 17*a* and 17*b*. It is understood that the elastic retraction of the cords 36 assists the venturi 33 during deflation.

In FIG. 6*b*, the air chamber 15 retraction device comprises a set of external elastic straps 37 as the elastically deformable return members, which encircle the air chamber 15 and retract it during deflation, after their expansion by elastic deformation during inflation of said air chamber 15.

In addition to such elastically deformable return members, or in place of such members, it is possible for the retraction device to comprise a pantograph collapsing mechanism, represented as deployed in FIG. 6*c* with the air chamber 15 inflated, and as collapsed in FIG. 6*d* with the air chamber 15 retracted between the plates 17*a* and 17*b* of the core 14. This mechanism comprises, for example, two rigid shields 38*a* and 38*b*, parallel to and spaced apart from each other, fixed to the inside edges of the air chamber 15 and connected to each other by a two-compass pantograph 39 and by a simple compass 40, the arms of the pantograph 39 and of the compass 40 being hinged to pivot around pivots parallel to each other and to the plane of the shields 38*a* and 38*b*, and perpendicular to a central axis 41 of the mechanism which is itself secured to the plates 17*a* and 17*b*, on which the arms of the pantograph 39 and the compass 40 also pivot and around which are mounted coil springs 42 compressed against stops 43 by axial displacement of the central axis 41 when the two shields 38*a* and 38*b* move apart from each other as the air chamber 15 inflates, due to the opening of the compass 40 and the two compasses forming the pantograph 39. When the air chamber 15 is deflated, the relaxation of the springs 42 previously compressed by the inflation causes the pantograph 39 and the compass 40 to close, which causes the two shields 38*a* and 38*b* to draw closer together and the air chamber 15 to collapse into its housing 19 in the core 14. The mechanism for collapsing the inside edges of the air chamber can be supplemented with a mechanism for collapsing the upper and lower edges 38*c* and 38*d*, consisting of a return shaft 44 connected to the return spring 45 compressed against the stop 46 which is secured to one of the plates 17*a* or 17*b* of the shutter.

Of course, other variations of the device for retracting the deflated air chamber into the housing of the core are possible. In the installation in FIG. 5, it may be advantageous to replace each individual manual control 31*a* to 31*n* with an individual remote control for inflation or deflation, such that simultaneous or individual air chamber 15 inflation and deflation operations can be controlled remotely. In another variation, the deflation of an air chamber 15 may be caused only by return members, with no assistance from a discharge venturi.

The invention claimed is:

1. A shutter with an inflatable seal, for a port of a hollow partition of a multi-chamber ring furnace, comprising:

a rigid core of a substantially rectangular elongated shape, for placement next to a port of a hollow partition of said furnace in order to seal off the major portion of the flow area for the gas passing through said port; and at least one inflatable air chamber, which is retracted into a housing in the core in its deflated state, and which forms a peripheral seal protruding around the edge of the core in its inflated state, such that said seal extends along its entire periphery in order to complete the sealing off of said port wherein said core comprises two rigid plates, substantially of the same flat shape, rigidly fixed by spacers to be apart from and facing one another, and delimiting between said plates a housing which receives the inflatable air chamber and which is peripherally open between the two plates to allow the formation of the peripheral seal when said air chamber is in the inflated state.

2. A shutter according to claim 1, wherein said two plates of the core are fixed to each other in a manner which can be disassembled for replacement of a damaged air chamber.

3. A shutter according to claim 1, characterized in that said air chamber is made of a material that is substantially airtight and is resistant to heat and to the temperatures and corrosive properties of the combustion gases and fumes of the furnace, and is elastically deformable or is flexible.

4. A shutter according to claim 1, equipped with a device to retract the deflated air chamber into the core.

5. A shutter according to claim 4, wherein said device to retract the deflated air chamber into the core comprises at least one elastically deformable return member internal or external to the air chamber, which expands as the air chamber is inflated and which elastically retracts to a relaxed state as the air chamber is deflated, retracting said air chamber into said core.

6. A shutter according to claim 4, wherein said retraction device comprises a pantograph collapsing mechanism, arranged in the air chamber such that the inflation of said air chamber causes two shields connected to each other by at least one pantograph to move apart, and an opening of the pantograph loads at least one return spring which, when the air chamber deflates, is released and causes the pantograph to close and the air chamber to collapse into its housing in the core.

7. A shutter according to claim 1, equipped with a maneuvering shaft secured to the core, by a lower end portion of the shaft, said shaft having an upper end portion which is equipped with a guide and brace piece to facilitate positioning the shutter inside the hollow partitions of the furnace and bracing the shutter in place on said furnace.

8. A shutter according to claim 7, wherein said maneuvering shaft has a tubular portion and is equipped at one end of the tubular portion with a quick coupling connector for connecting to an inflation/deflation system with a compressed air supply, the other end of the tubular portion of the shaft being connected to the inside of the air chamber.

9. A shutter according to claim 7, equipped with a visual control device mounted on said shaft to monitor the inflation pressure of the air chamber.

10. A shutter according to claim 1, wherein said rigid core is arranged to allow bracing the shutter against the base of the corresponding port or between said base of the port and a spacer internal to the corresponding partition.

11. A sealing system for sealing off at least one port of a hollow partition of a multi-chamber ring furnace, comprising at least one shutter comprising a rigid core of a substantially rectangular elongated shape, for placement next to a port of a hollow partition of the furnace in order to seal off a major portion of a flow area for gas passing through the port, and at least one inflatable air chamber, which is retracted into a housing in said core in a deflated state of said air chamber, and which forms a peripheral seal protruding around an edge of said core in an inflated state of said air chamber, such that the seal extends along an entire periphery of said core in order to complete the sealing off of the port, the sealing system further comprising an air chamber inflation/deflation system, comprising a connector for connecting to a compressed air supply, and connected to a pressure regulator which is connected to an inflation/deflation selector valve connected on the one hand to the air chamber of said at least one shutter, for inflating said air chamber by means of a safety valve and an individual manual control of the inflation and deflation of said air chamber, and on the other hand to a discharge venturi, connected to said air chamber by said individual control and a pilot valve controlled by said selector valve, for selectively controlling the isolation of the venturi when the air chamber is inflated and the supply of compressed air to the venturi to permit said air chamber to deflate by suction wherein said core comprises two rigid plates, substantially of the same flat shape, rigidly fixed by spacers to be apart from and facing one another, and delimiting between said plates a housing which receives the inflatable air chamber and which is peripherally open between the two plates to allow the formation of the peripheral seal when said air chamber is in the inflated state.

12. A sealing system according to claim 11, for sealing off ports of hollow partitions of a chamber of said furnace, comprising a shutter respectively for each of the hollow partitions of said furnace chamber, the shutter being connected in parallel to the inflation/deflation selector valve and to the discharge venturi of an inflation/deflation system common to the air chambers of the shutters.

13. A sealing system according to claim 12, wherein said shutters are placed together on a common sealing platform, equipped with a respective supporting arm to support each shutter positioned outside the corresponding hollow partition, and with a connector to at least one of a compressed air distributor network and at least one air compressor such that the inflation/deflation system is supplied with air.

* * * * *